United States Patent [19]

Wirtgen

[11] Patent Number: 5,016,943

[45] Date of Patent: May 21, 1991

[54] MILLING DEVICE FOR CUTTING UP ROAD SURFACES

[76] Inventor: Reinhard Wirtgen, Hohner Strasse 2, D-5469 Windhagen, Fed. Rep. of Germany

[21] Appl. No.: 494,240

[22] Filed: Mar. 15, 1990

[30] Foreign Application Priority Data

Mar. 23, 1989 [DE] Fed. Rep. of Germany ..... 3909695

[51] Int. Cl.[5] ..... F01C 23/12; E21C 25/10

[52] U.S. Cl. ..... 299/87; 299/39

[58] Field of Search ..... 299/39, 86, 87, 88, 299/89, 91, 93, 79; 175/394, 377

[56] References Cited

U.S. PATENT DOCUMENTS

| | | | |
|---|---|---|---|
| 4,119,350 | 10/1978 | Sander et al. | 299/87 |
| 4,268,089 | 5/1981 | Spence et al. | 299/87 |
| 4,451,092 | 5/1984 | Best et al. | 299/87 X |
| 4,480,873 | 11/1984 | Latham | 299/87 |

FOREIGN PATENT DOCUMENTS

| | | | |
|---|---|---|---|
| 2644992 | 12/1987 | Fed. Rep. of Germany . | |
| 819328 | 4/1981 | U.S.S.R. | 299/91 |
| 1086563 | 10/1967 | United Kingdom | 299/87 |

*Primary Examiner*—Ramon S. Britts
*Assistant Examiner*—David J. Bagnell
*Attorney, Agent, or Firm*—W. Thad Adams, III

[57] ABSTRACT

A milling device for cutting up road surfaces which includes a roller-type milling body including a rotatably-mounted spiral conveyor, a plurality of rotary cutters carried on the spiral conveyor, the rotary cutters mounted for free rotation about their respective longitudinal axes. A plurality of retaining boxes is provided, each retaining box detachably connected by at least one screw in a respective trapezoidally-shaped positive radial recess in a wall of the spiral conveyor, each retaining box having a bore hole therein for receiving a respective one of the rotary cutters. The retaining boxes each have a trapezoidally-shaped shaft part for being matingly received in the trapezoidal recess with the narrow side of the trapezoidally-shaped shaft facing towards the spiral conveyor.

4 Claims, 2 Drawing Sheets

MILLING DEVICE FOR CUTTING UP ROAD SURFACES

Figure 2:
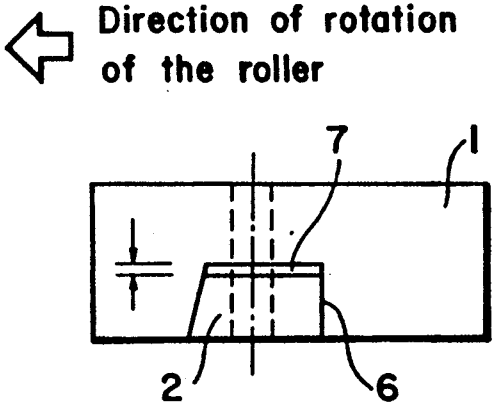

The invention relates to a milling device for cutting up road surfaces having a roller-type milling body, which is constructed in the form of a spiral conveyor and is mounted rotatably, and having a multitude of rotary shaft cutters, which are attached to the spiral conveyor and are freely rotatable about their respective longitudinal axis.

A milling device of this type is disclosed, for example, in our own older German Patent 2,644,992, in which the rotary shaft cutters are arranged in socket-shaped fixtures which are welded onto the side wall of the spiral conveyor.

The rotary shaft cutters are subjected to severe wear both at their projecting free end and in respect of their fixture.

Whereas the worn rotary shaft cutters can be replaced by new ones relatively easily, the damage also occurring at the same time in the socket-type fixtures can only be remedied with difficulty. The welded-on sockets rather have to be burnt off and, at great effort, new sockets for the fixture of the rotary shaft cutters have to be welded onto the spiral conveyor.

Setting out from this known prior art, the object of the present invention is to develop a milling device of the type defined at the beginning in such a way that the equipping times of the machine are substantially shortened and the economic efficiency is consequently improved.

This object according to the invention is achieved by a milling device of the type defined at the beginning which is characterized in that each rotary shaft cutter is arranged in the borehole of a retaining box which is attached detachably to the spiral conveyor.

The retaining box is preferably screwed onto a side wall of the spiral conveyor.

In view of the extremely high forces acting on the retaining boxes via the milling cutters, it has proved to be particularly expedient if the retaining boxes are inserted in a positive radial recess in the side wall of the spiral conveyor and are attached by means of screws.

In this manner, the fixing screws simply hold the retaining box in position while the relatively high forces are transmitted directly from the conveyor wall to the shaft of the retaining box.

According to a particularly advantageous embodiment, the retaining boxes are constructed in their shaft part as cubes which can be inserted into corresponding recesses of the spiral conveyor and can be attached by means of screws.

According to another advantageous embodiment of the present invention, the retaining boxes are constructed in their shaft part to be approximately trapezoidal in section, in which case they are attached in the recess with the narrow side towards the spiral conveyor. Retaining boxes are proved to be particularly advantageous which, seen in section, represent a rectangle with two adjacent right-angled corners and are attached in the recess in such a way that the narrow side is directed towards the spiral and the adjacent right-angled side, seen in the direction of rotation of the spiral, represents the rear side of the retaining box.

In the case of an embodiment of this type, a force component is developed during the rotational movement of the rotary body and the spiral conveyor mounted on it, which force component is directed into the right-angled corner of the recess and thus the retaining box is pressed into the recess such that the milling operation itself supports the fixture of the retaining box on the spiral wall.

It has proved to be particularly expedient if the retaining boxes for accommodating the rotary shaft cutters are arranged on the side wall of the spiral conveyor which is ineffective in respect of material transport.

The rotary shaft milling cutters can, in effect, be arranged in the retaining boxes in any position, for example in a radial position in relation to the milling roller.

According to a particularly advantageous embodiment, the rotary shaft cutters are nevertheless inserted in the retaining boxes at an angle deviating from the radial direction. It is achieved by an embodiment of this kind that the rotary shaft cutters are effective on the road surface to be cut up in the direction of their longitudinal axis.

The screws used for attaching the retaining boxes are preferably arranged in a countersunk manner so that they are not damaged during the milling operation. Appropriate retainer rings are used in a customary manner for arranging the rotary shaft cutters in the retaining boxes.

The attachment of the rotary shaft cutters in the retaining box screwed on according to the invention enables easy exchange of worn cutter fixtures directly at the site of operation of the machine, which is not the case with the previous embodiment.

Figure 1:
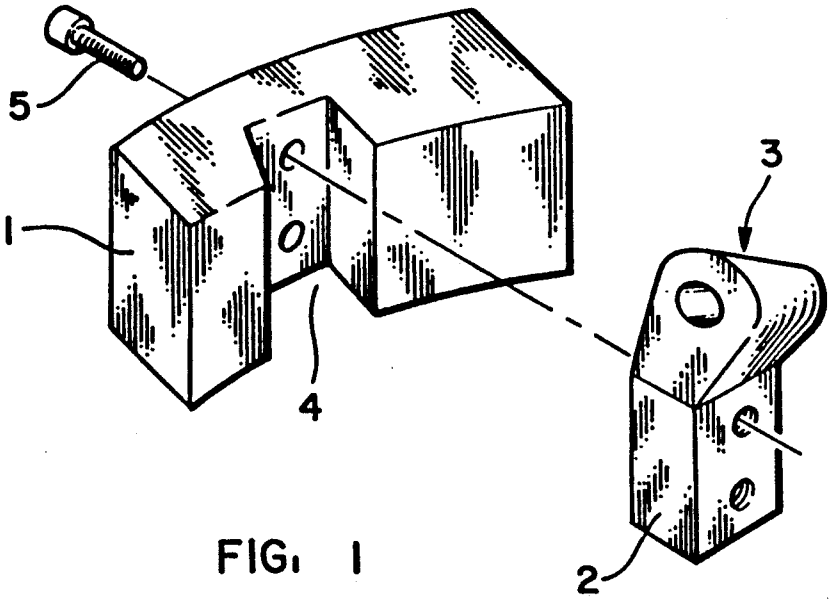
Figure 3:
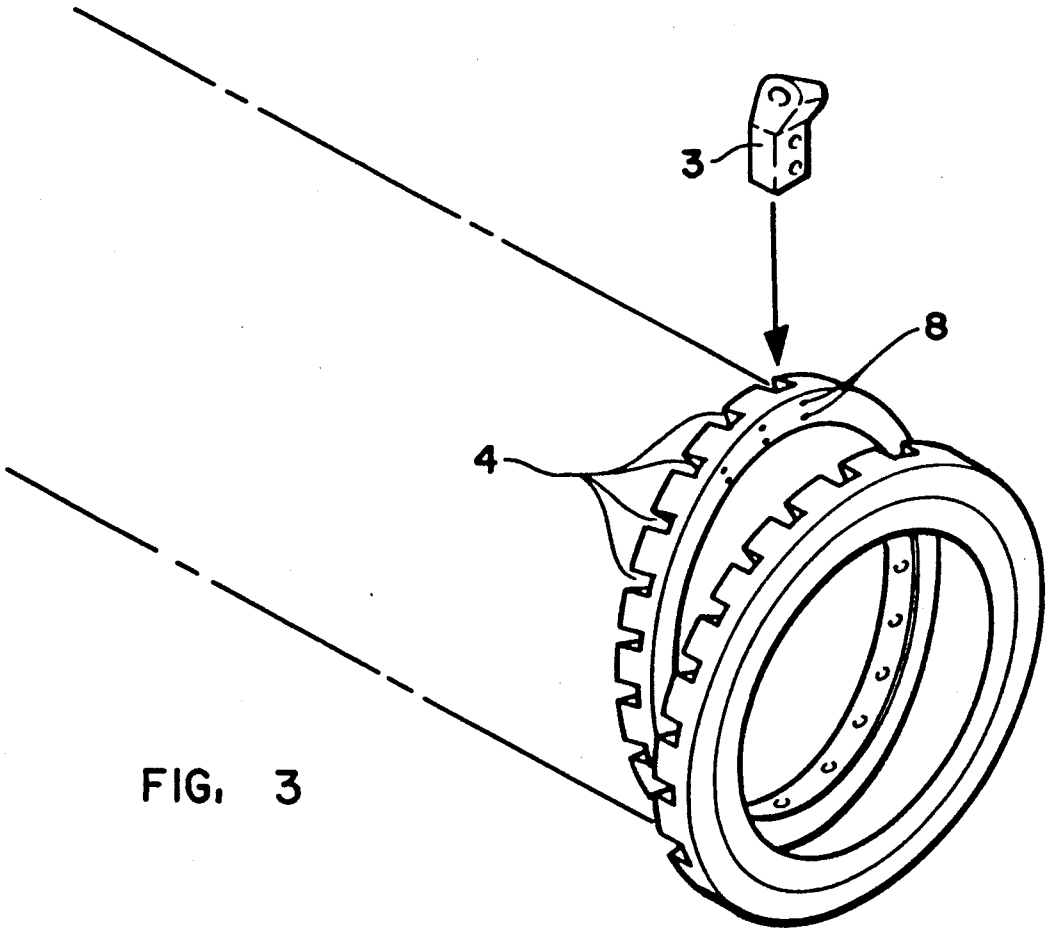

The invention is described in greater detail below with reference to exemplary embodiments illustrated in the drawings, in which:

FIG. 1 shows a partial view of the spiral conveyor provided on the milling roller with the recess provided for accommodating the shaft part of the retaining box, FIG. 2 shows the arrangement of the shaft part of the retaining box in the recess of the spiral conveyor in section as a partial view, FIG. 3 shows a detail of the milling roller with the spiral conveyor provided on it with the recesses provided for accommodating the retaining boxes.

In the spiral conveyor 1 shown as a partial view in FIG. 1, a recess 4 is provided in the side wall for accommodating the shaft part 2, which is rectangular in section, of the retaining box 3, into which recess the shaft part 2 can be inserted and can be attached by means of screws 5. A rotary cutter 9 is mounted in the retaining box 3 for free rotation about its longitudinal axis.

In the detail illustrated in section according to FIG. 2, a special embodiment is represented in the shaft part of the retaining box 3 represents a trapezoid with two adjacent right-angled corners and is attached in the recess in such a way that the narrow side is directed towards the spiral 1 and the adjacent right-angled side 6, seen in the direction of rotation, represents the rear side of the retaining box 2.

As can also be seen from this sectional FIG. 2, there is a certain clearance region 7 between the shaft part 2 of the retaining box and the spiral conveyor 1 so that the shaft part 2 of the retaining box 3 is drawn into the recess 4 of the spiral conveyor always fitting snugly with the aid of the screws 5 passed through the spiral conveyor 1.

FIG. 3 is another diagrammatic illustration of the arrangement of the spiral conveyor on the milling roller with the recesses 4 for accommodating the retaining boxes 3. Furthermore, the screw holes 8 passing through the spiral conveyor 1 for attaching the retaining box 3 in the recesses 4 can also be recognized in this figure.

I claim:

1. A milling device for cutting up road surfaces and comprising:

(a) a roller-type milling body including a rotatably-mounted spiral conveyor;

(b) a plurality of rotary cutters carried on said spiral conveyor, said rotary cutters mounted for free rotation about their respective longitudinal axes;

(c) a plurality of retaining boxes, each retaining box detachably connected by at least one screw in a respective trapezoidally-shaped positive radial recess in a wall of said spiral conveyor, each retaining box having a bore hole therein for receiving a respective one of said rotary cutters; and (d) said retaining boxes each having a trapezoidally-shaped shaft part for being matingly received in the trapezoidal recess with the narrow side of the trapezoidally-shaped shaft facing towards the spiral conveyor.

2. A milling device according to claim 1, wherein, as seen in section, the retaining boxes represent a trapezoid with two adjacent right-angled corners and are attached in the recess in such a way that the narrow side is directed towards the spiral and the adjacent right-angled side, seen in the direction of rotation, represents the rear side of the retaining box.

3. A milling device according to claim 1, wherein the retaining boxes are arranged on the sidewall of the spiral conveyor which is ineffective for transport of cut-up road surface material.

4. A milling device according to claim 1, wherein the rotary cutters are inserted in the retaining boxes at an angle deviating from the radial direction.

* * * * *